US011383511B2

(12) United States Patent
Takagi et al.

(10) Patent No.: US 11,383,511 B2
(45) Date of Patent: Jul. 12, 2022

(54) IMAGE RECORDING APPARATUS

(71) Applicant: CANON KABUSHIKI KAISHA, Tokyo (JP)

(72) Inventors: Yosuke Takagi, Kanagawa (JP); Chiaki Muraoka, Saitama (JP); Akira Goto, Kanagawa (JP); Kyosuke Toda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/341,308

(22) Filed: Jun. 7, 2021

(65) Prior Publication Data

US 2021/0394509 A1 Dec. 23, 2021

(30) Foreign Application Priority Data

Jun. 17, 2020 (JP) ..... JP2020-104689

(51) Int. Cl.
*B41J 2/04* (2006.01)
*B41J 2/045* (2006.01)

(52) U.S. Cl.
CPC ..... *B41J 2/0452* (2013.01); *B41J 2/04586* (2013.01)

(58) Field of Classification Search
CPC .. B41J 2/0452; B41J 2/04586; B41J 2/17503; B41J 2/17566; B41J 2/1752; B41J 2/0451; B41J 2/04513; B41J 2/04571
See application file for complete search history.

(56) References Cited

U.S. PATENT DOCUMENTS

| | | | | |
|---|---|---|---|---|
| 5,917,514 | A | 6/1999 | Higuma et al. | 347/29 |
| 6,631,982 | B2 | 10/2003 | Sasaki et al. | 347/85 |
| 6,805,437 | B2 | 10/2004 | Yamanaka et al. | 347/92 |
| 6,851,795 | B2 | 2/2005 | Watanabe et al. | 347/50 |
| 6,945,643 | B2 | 9/2005 | Tajima et al. | 347/87 |
| 7,044,588 | B2 | 5/2006 | Tajima et al. | 347/85 |
| 8,500,265 | B2 | 8/2013 | Yamakami et al. | 347/100 |
| 8,757,776 | B2 | 6/2014 | Yamakami et al. | 347/54 |

(Continued)

FOREIGN PATENT DOCUMENTS

JP 2015-223830 12/2015

OTHER PUBLICATIONS

Extended European Search Report dated Oct. 20, 2021 in counterpart EP Application No. 21179528.1.
U.S. Appl. No. 17/344,856, filed Jun. 10, 2021.

*Primary Examiner* — Kristal Feggins
(74) *Attorney, Agent, or Firm* — Venable LLP

(57) ABSTRACT

An image recording apparatus includes a liquid chamber, a first electrode pin and a second electrode pin which are inserted into the liquid chamber, application unit for applying a voltage between the first electrode pin and the second electrode pin, and detection unit for detecting a current which flows between the first electrode pin and the second electrode pin, the image recording apparatus has: a first period in which the application unit applies the voltage between the first electrode pin and the second electrode pin, with the first electrode pin as an anode side and the second electrode pin as a cathode side, and the detection unit detects the current; and a second period in which the application unit applies the voltage between the first electrode pin and the second electrode pin, with the first electrode pin as the cathode side and the second electrode pin as the anode side.

13 Claims, 9 Drawing Sheets

(56) References Cited

U.S. PATENT DOCUMENTS

| | | | | |
|---|---|---|---|---|
| 9,321,274 | B2 | 4/2016 | Takagi et al. | B41J 2/1752 |
| 9,533,504 | B2 | 1/2017 | Takagi et al. | B41J 2/1433 |
| 9,597,884 | B2 | 3/2017 | Nanjo et al. | B41J 2/17526 |
| 9,821,562 | B2 | 11/2017 | Nanjo et al. | B41J 2/17523 |
| 9,840,082 | B2 | 12/2017 | Nanjo et al. | B41J 2/17513 |
| 10,207,511 | B2 | 2/2019 | Nanjo et al. | B41J 2/175 |
| 2007/0146428 | A1 | 6/2007 | Sakai et al. | 347/50 |
| 2015/0343779 | A1 | 12/2015 | Takagi et al. | 347/50 |
| 2016/0052289 | A1 | 2/2016 | Kosaka et al. | 347/6 |
| 2016/0052290 | A1 | 2/2016 | Takahashi et al. | 347/7 |
| 2019/0263135 | A1 | 8/2019 | Abe et al. | B41J 2/18 |
| 2020/0180308 | A1* | 6/2020 | Moriya | B41J 2/0458 |
| 2020/0207103 | A1 | 7/2020 | Tamaru et al. | B41J 2/17509 |
| 2020/0290362 | A1 | 9/2020 | Tajima et al. | B41J 2/17509 |
| 2021/0162766 | A1 | 6/2021 | Omura et al. | B41J 2002/17579 |
| 2021/0197548 | A1* | 7/2021 | Matsumoto | B41J 2/04581 |
| 2021/0300019 | A1* | 9/2021 | Yoshida | B41J 2/17566 |

* cited by examiner

IMAGE RECORDING APPARATUS

BACKGROUND OF THE INVENTION

Field of the Invention

The present invention relates to an image recording apparatus which performs recording of an image by ejecting liquid such as ink to a recording medium.

Description of the Related Art

Conventionally, as means for performing image recording by ejecting liquid such as ink to a recording medium such as paper, there are proposed various recording methods each using a liquid ejection cartridge unit and, for example, a thermal transfer method, a wire dot method, a thermal method, and an inkjet method are put to practical use. Among them, the inkjet method attracts attention as a recording method which has a low running cost and is capable of suppressing recording sound, and is used in a wide variety of fields. In the inkjet method, by driving a recording element substrate provided in the liquid ejection cartridge unit, an ink droplet is ejected to the surface of the recording element substrate from an ink ejection port formed by a nozzle member. The inkjet method is the image recording method which performs image formation by causing the ink droplet to land on a desired position on a paper surface. In the inkjet method, in many cases, a signal or power for driving the recording element substrate is supplied from an image recording apparatus, in which the liquid ejection cartridge unit is provided, to the liquid ejection cartridge unit via an electrical connection section.

A mode of supplying liquid such as ink, which is used for image formation, to the liquid ejection cartridge unit has various configurations. In a representative mode, by connecting a liquid tank having a liquid accommodation chamber which is separate from the liquid ejection cartridge unit directly to the liquid ejection cartridge unit, liquid in the liquid tank is supplied to the liquid ejection cartridge unit. In addition, a tube supply method in which ink is supplied from a liquid tank set in an image recording apparatus to a liquid ejection cartridge via a liquid supply tube is also put to practical use. In the case of the tube supply method, it is common to use a configuration in which a sub-tank is provided in the liquid ejection cartridge unit, liquid supplied from the liquid supply tube is retained temporarily in the sub-tank, and the liquid is then supplied to the recording element substrate.

In any method described above, the liquid supplied from a liquid supply source is guided into the liquid ejection cartridge, and is then guided to the recording element substrate via a liquid supply passage formed in the case of the liquid ejection cartridge unit. The image recording apparatus needs the function of ascertaining a liquid remaining amount of the supply source. The representative objects are the following two objects. The first object is to display, when the liquid remaining amount of the supply source becomes small, the shortage of the liquid for a user to urge the user to replace the liquid tank or infuse the liquid. The second object is to use the liquid remaining amount as a trigger for print control such as divided printing in order to prevent destruction of the nozzle member which may be caused in the case where an ejection operation is executed in a state in which no liquid is left.

As a detection method of the liquid remaining amount, various methods have been proposed. A dot count method in which the liquid remaining amount is calculated from the number of liquid ejections, a prism method in which a liquid accommodation chamber is irradiated with light, the level of reflected light is acquired with a sensor, and the liquid remaining amount is determined, and a pin remaining amount detection method in which an electrode pin is inserted into a liquid accommodation chamber and an electrical response is obtained have been proposed. Among the methods described above, the pin remaining amount detection method requires a relatively low cost to be introduced and has high detection accuracy, and hence the method has been widely performed.

In the common pin remaining amount detection method, electric signals are applied to two electrode pins inserted into the liquid accommodation chamber, and liquid remaining amount detection is thereby performed. Most of liquid such as ink, which is used in the image recording described above, conducts electricity. Accordingly, in the case where liquid is present in the liquid accommodation chamber (a state in which two electrode pins are in contact with the liquid), when the electric signals are applied to the electrode pins, a current flows between the electrode pins via the liquid. On the other hand, in the case where the liquid is not present (a state in which two electrode pins are not in contact with the liquid), an electrical path does not exist between the electrode pins, and hence the current does not flow. Based on such characteristics, a configuration is adopted in which the presence or absence of the liquid is determined by applying the electric signal between the electrode pins and obtaining the electrical response (Japanese Patent Application Publication No. 2015-223830).

SUMMARY OF THE INVENTION

However, in the configuration described in Japanese Patent Application Publication No. 2015-223830, the following problem may occur.

A metal SUS material or the like is mainly used as the material of the electrode pin and, when one of the two electrode pins is used as an anode side and the other one thereof is used as a cathode side, and an operation of causing a current to flow in one direction is repeated in a state in which liquid is present between the electrode pins, there are cases where an oxidation-reduction reaction of metal occurs on the electrode pin surface. That is, oxidation progresses on the surface of the anode-side electrode pin, and reduction progresses on the surface of the cathode-side electrode pin. When the above reaction progresses, electrical resistance is increased due to an influence of the oxidation of the anode-side electrode pin, and hence a current value of a current flowing between the electrode pins is decreased irrespective of the state in which the liquid is present. In this case, a difference in response between the case where the liquid is present and the case where the liquid is not present is reduced, and there is a concern that detection accuracy of the liquid remaining amount may be reduced.

When the detection accuracy of the liquid remaining amount is reduced, in one case, irrespective of the state in which the liquid is present, the user may be urged to replace the liquid tank, or a divided printing mode may be established and a reduction in printing speed may be caused. In another case, irrespective of a state in which the liquid is absent, the absence of the liquid may not be displayed, idle ejection printing may be performed, and the nozzle member may be thereby destructed.

Thus, the reduction in the detection accuracy of the liquid remaining amount is not preferable in terms of usability and reliability.

An object of the present invention is to provide a technique capable of improving detection accuracy of the remaining amount of liquid.

In order to attain the above object, an image recording apparatus of the present invention includes:

a liquid chamber which stores liquid used for recording of an image;

a first electrode pin and a second electrode pin which are inserted into the liquid chamber;

application unit for applying a voltage between the first electrode pin and the second electrode pin; and detection unit for detecting a current which flows between the first electrode pin and the second electrode pin, wherein the image recording apparatus has a first period in which the application unit applies the voltage between the first electrode pin and the second electrode pin, with the first electrode pin being used as an anode side and the second electrode pin being used as a cathode side, and the detection unit detects the current, and a second period in which the application unit applies the voltage between the first electrode pin and the second electrode pin, with the first electrode pin being used as the cathode side and the second electrode pin being used as the anode side.

According to the present invention, it is possible to improve the detection accuracy of the remaining amount of the liquid.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1A:
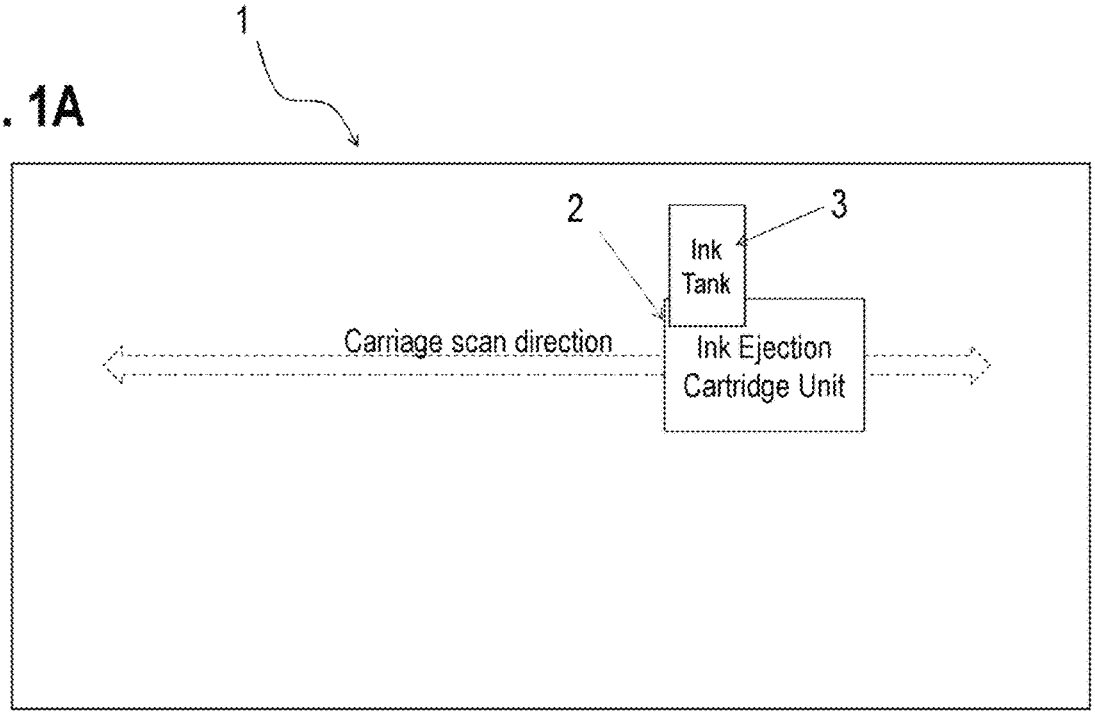
FIG. 1A.
Figure 1B:
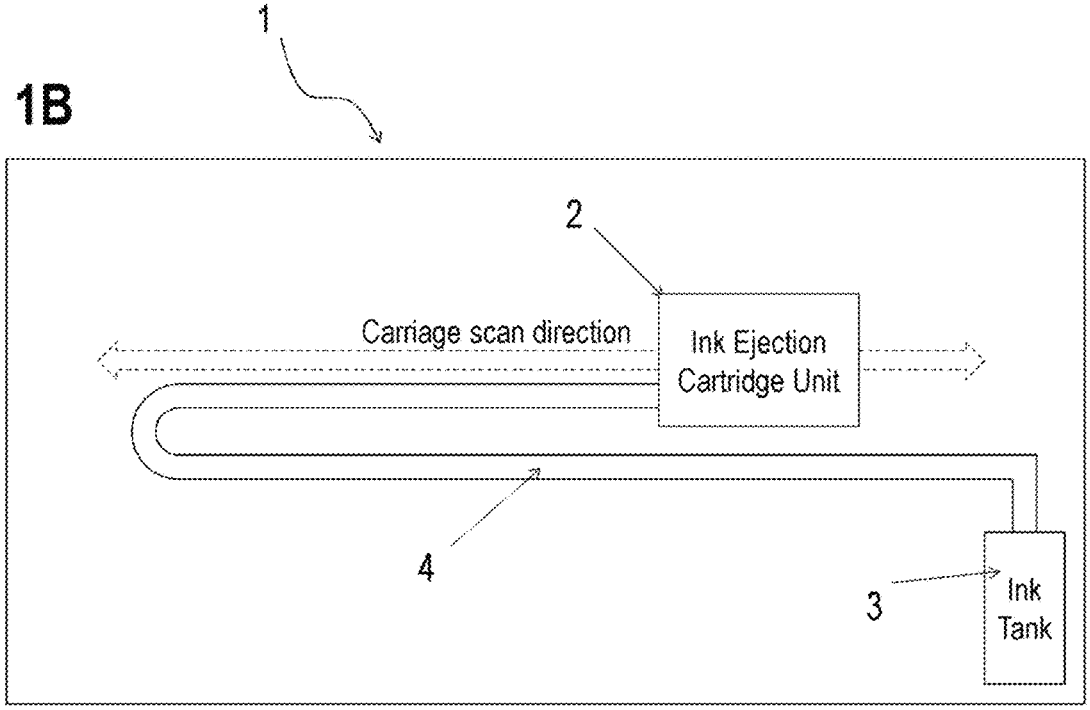
FIG. 1B are schematic views showing an example of the apparatus configuration of an image recording apparatus according to an embodiment of the present invention.

FIG. 1A and FIG. 1B are simplified schematic views of an image recording apparatus 1 and a liquid ejection cartridge unit 2 according to an embodiment of the present invention. FIG. 1A and FIG. 1B show the image recording apparatuses 1 having different liquid supply methods to the liquid ejection cartridge unit 2. The present invention can be suitably applied to each configuration. FIG. 1A shows the configuration of what is called an on-carriage ink tank method. That is, an ink tank 3 serving as a liquid tank which accommodates ink serving as liquid used for image recording is directly connected to the liquid ejection cartridge unit 2 having an ink ejection function, and ink supply is performed. On the other hand, FIG. 1B shows the configuration of what is called a tube supply method. That is, ink serving as liquid is supplied to the liquid ejection cartridge unit 2 from the ink tank 3 disposed in the image recording apparatus via an ink supply tube 4 serving as a liquid supply tube.

In any method shown in FIG. 1A and FIG. 1B, it is necessary to have the function of detecting suspension of ink supply in the case where the ink supply to the liquid ejection cartridge unit 2 is suspended. Main objects of ink remaining amount detection are the following two objects. First, the ink remaining amount detection is used to display information that the ink tank 3 is empty for a user and urge the user to replace the ink tank 3 or refill the ink tank 3 with ink. Second, the ink remaining amount detection is used to prevent destruction of a nozzle member which can occur during idle ejection by detecting, in advance, that an ejection operation is performed in a state in which ink is not present in the liquid ejection cartridge unit 2 and using the detection result as a trigger for print control such as printing suspension or divided printing. In particular, in the configuration of the tube supply method shown in FIG. 1B, even when ink remains in the ink tank 3, there are cases where air passes through the ink supply tube 4 and enters an ink supply channel due to being left unattended for a long time. In order to detect idle ejection which occurs in this case, a configuration for detecting the ink remaining amount is provided in the liquid ejection cartridge unit 2 in the present embodiment.

Figure 2B:
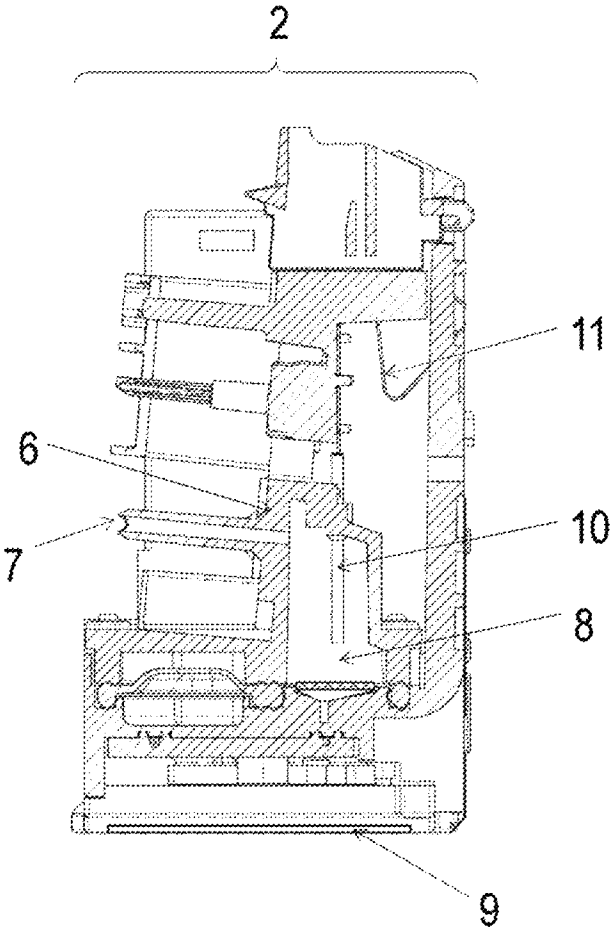
FIG. 2A and FIG. 2B are explanatory views of the configuration of a liquid ejection cartridge unit.
Figure 2A:
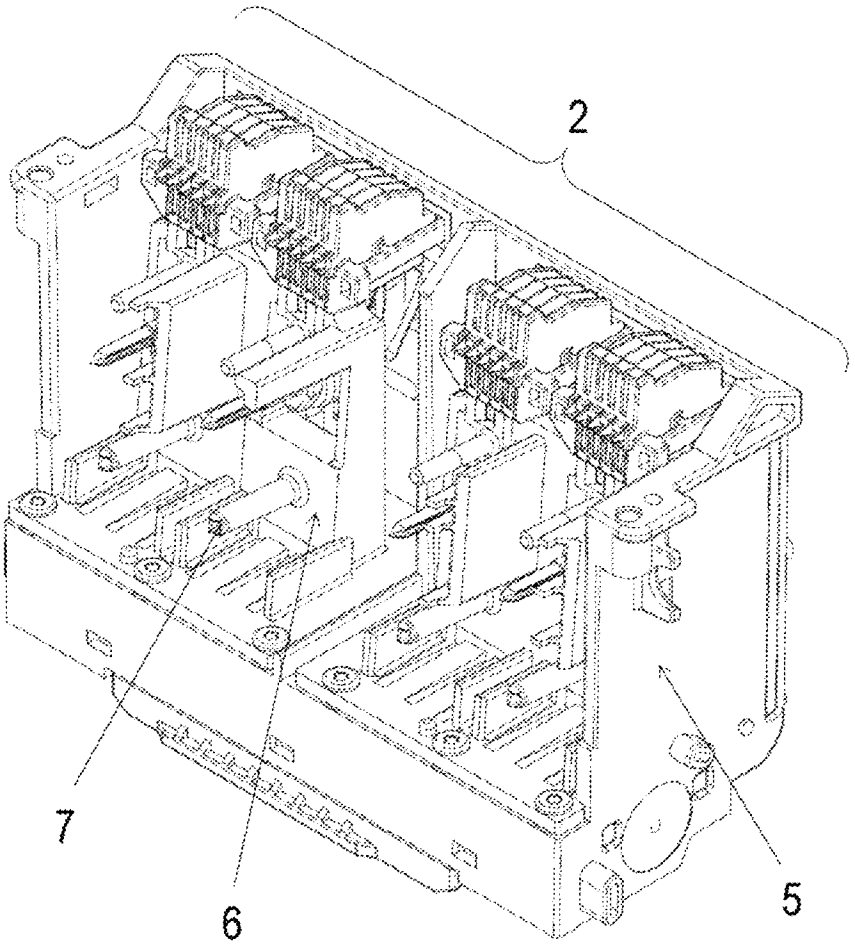

FIG. 2A and FIG. 2B shows the detailed configuration of the liquid ejection cartridge unit 2 having the ink remaining amount detection function inside the liquid ejection cartridge unit 2. FIG. 2A is a perspective view of the liquid ejection cartridge unit, and FIG. 2B is a transverse sectional view of the liquid ejection cartridge unit.

The liquid ejection cartridge unit 2 is a unit in which a head unit 5 is combined with a sub-tank 6. Ink supplied from the ink tank 3 or the ink supply tube 4 is caused to flow into the liquid ejection cartridge unit 2 from each of joint sections 7 which are equal in number to the number of ink colors and are provided in the sub-tanks 6 independently of each other. A sub-tank liquid chamber 8 is formed in the sub-tank 6, and the supplied ink is temporarily retained and stored in the sub-tank liquid chamber 8 and is then guided to a recording element substrate 9 through an ink supply passage formed in the case of the head unit 5.

In each sub-tank liquid chamber 8, two electrode pins 10 are inserted in order to detect the presence or absence of ink in the sub-tank liquid chamber 8. Note that FIG. 2B shows only one electrode pin 10. However, two pins are actually arranged in a vertical direction with respect to a paper surface, and one of the electrode pins 10 is hidden behind the other electrode pin 10. As the material of the electrode pin 10, SUS304 selected from among stainless steels is used based on cost and workability in the present embodiment, but other metal materials may also be used. The electrode pin 10 to be inserted has a contact with an electrical connection member 11 at an end opposite to an end protruding into the sub-tank liquid chamber 8, and is electrically connected to the image recording apparatus 1 via the electrical connection member 11.

Figure 3:
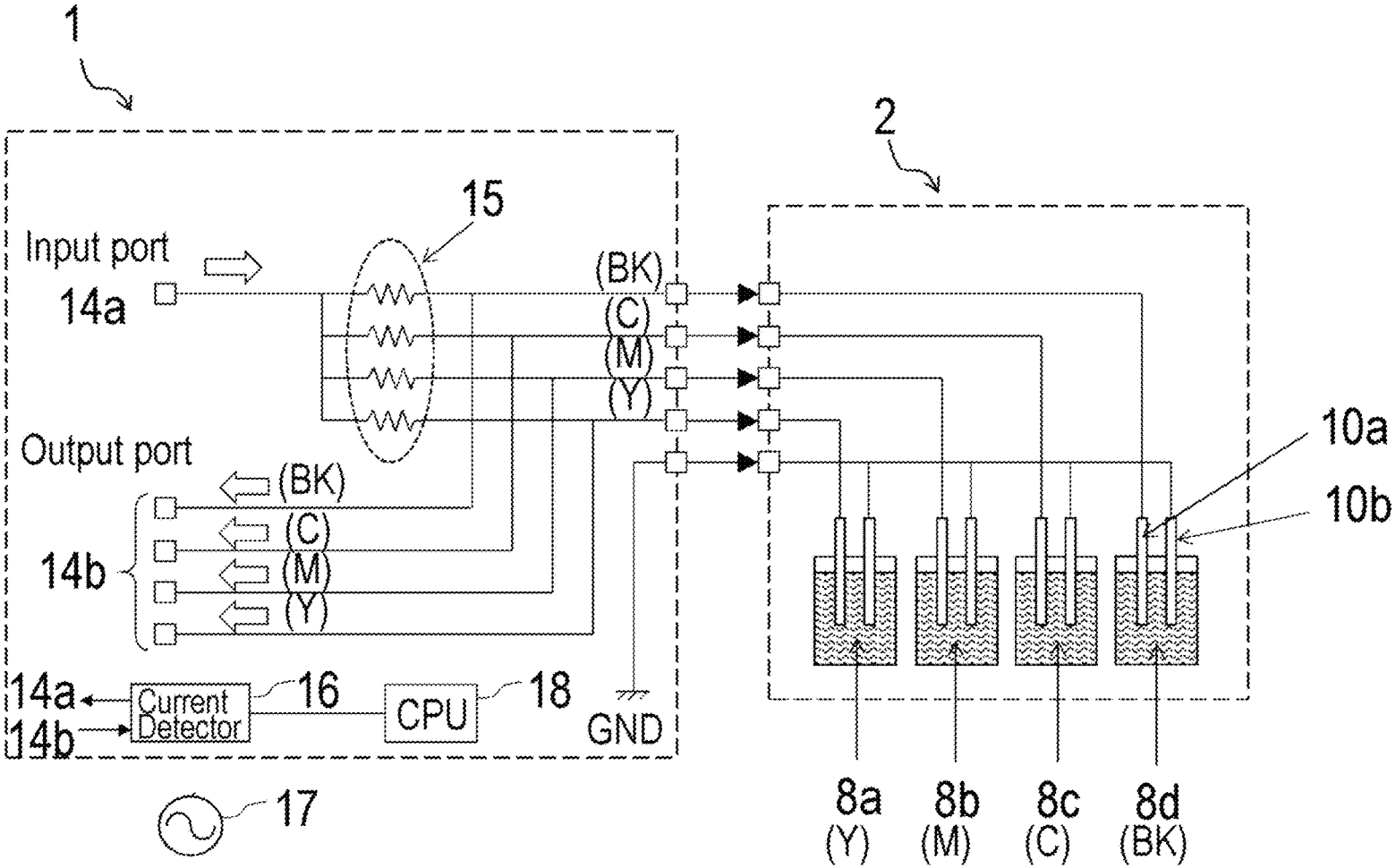
FIG. 3 is a circuit configuration diagram of a detection system of an ink remaining amount of the embodiment of the present invention.

FIG. 3 simply shows the system configuration for detecting the ink remaining amount with the electrode pin 10. A signal used to perform remaining amount detection is input from an input port 14*a* on the side of an apparatus main body of the image recording apparatus 1. The input signal is caused to branch into signals equal in number to the number of inks which are subject to the remaining amount detection, and the signals are connected to the anode sides of the anode-side electrode pins 10*a* provided in the individual sub-tank liquid chambers 8 of the liquid ejection cartridge unit 2 via individual detection resistors 15. In addition, the cathode-side electrode pin 10*b* provided in each sub-tank liquid chamber 8 is caused to short out in the liquid ejection cartridge unit 2, and is connected to a GND terminal of the image recording apparatus 1. On the other hand, an output port 14*b* for the remaining amount detection is connected between the detection resistor 15 and the anode-side electrode pin 10*a*, and the output ports 14*b* equal in number to the number of ink colors subjected to detection are provided.

In the configuration described above, a voltage dividing ratio between the detection resistor 15 and the electrical resistance R of the ink is used as an output, and a current detector 16 of the image recording apparatus 1 detects the output and transmits the output to a control section 18 which controls the operation of the image recording apparatus 1. As voltage application unit, the control section 18 can control a power supply circuit which uses a commercial power supply 17 to which the image recording apparatus 1 is connected as a power supply source, and optionally control the magnitude and polarity of a voltage applied, as an electric signal, between the electrode pins 10*a* and 10*b*. The control section 18 can acquire the voltage between the electrode pins 10*a* and 10*b* with a current value detected by the current detector 16 serving as current detection unit connected to such a power supply circuit, and detect the ink remaining amount in each sub-tank liquid chamber 8 with the magnitude of the voltage. The configuration described thus far constitutes a liquid remaining amount detection mechanism in the image recording apparatus 1 of the present embodiment.

In the case where ink is not present in the sub-tank liquid chamber 8, a state between the anode-side and cathode-side electrode pins 10*a* and 10*b* is an electrically open state, and hence a current does not flow to the side of the liquid ejection cartridge unit 2. Consequently, a voltage close to an input signal is detected at the output port 14*b*. On the other hand, in the case where ink is present in the sub-tank liquid chamber 8, the anode-side and cathode-side electrode pins 10*a* and 10*b* are electrically connected via the ink, and hence the current flows to the side of the liquid ejection cartridge unit 2. Consequently, the signal detected at the output port 14*b* is an output having a voltage level lower than that of the input signal.

Figure 4A:
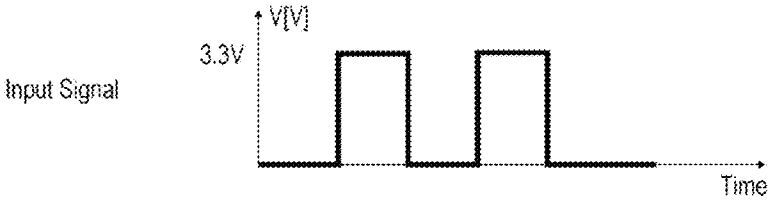
FIG. 4A to FIG. 4E are views showing examples of an input signal and an output signal of ink remaining amount detection.
Figure 4B:
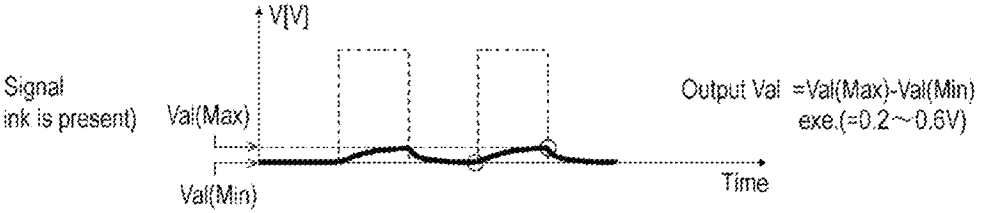
Figure 4C:
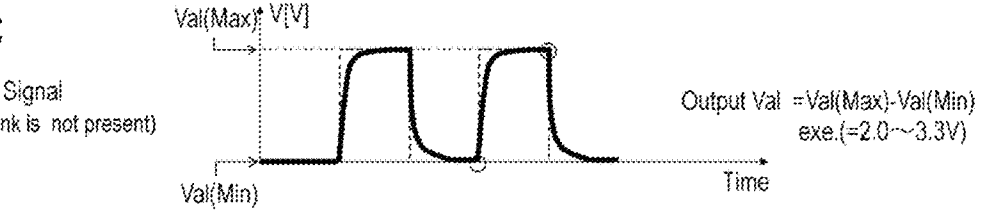

With regard to the above-described output level, FIG. 4A to FIG. 4E show examples of a conventional detection system. In the remaining amount detection configuration which has been conventionally adopted, as shown in FIG. 4A, as a detection signal input from the input port 14*a*, two rectangular pulses having 3.3 V are used. On the side of the output port 14*b*, an output "Val (Min)" immediately before the input of the second pulse and an output "Val (Max)" immediately before the fall of the second pulse are acquired, and detection is performed with a remaining amount detection output (Output Val)="Val (Max)−Val (Min)". In the case where the ink is present, as shown in an example in FIG. 4B, the remaining amount detection output is about 0.2 V to 0.6 V which is a low output. On the other hand, in the case where the ink is not present, as shown in FIG. 4C, the remaining amount detection output is about 2.0 V to 3.3 V.

Figure 4D:
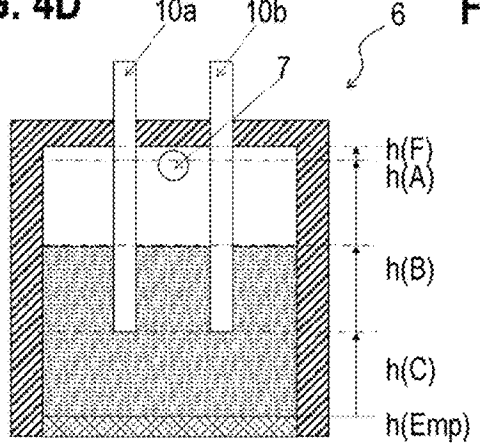
Figure 4E:
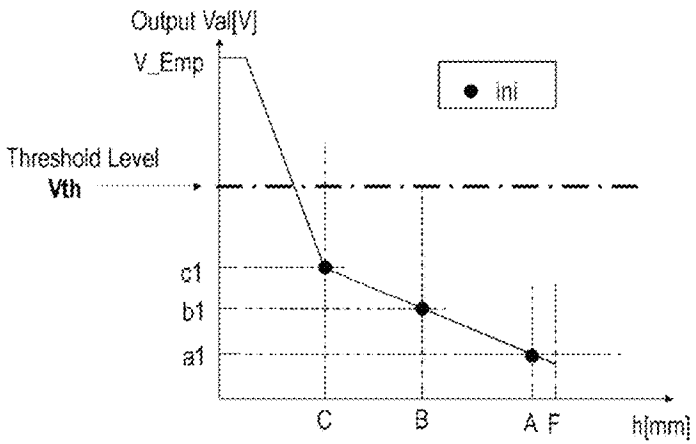

FIG. 4D is a schematic cross-sectional view of the sub-tank liquid chamber 8, and FIG. 4E shows changes of the ink remaining amount in the sub-tank liquid chamber 8 and the remaining amount detection output. When the ink is gradually consumed at water levels at which the ink is in contact with the electrode pin 10 (water level h (A)→h (B)→h (C)), the remaining amount detection output changes with a gentle gradient of a1→b1→c1. When the ink level moves away from the electrode pin 10, the gradient of the output change is increased. In the remaining amount detection, it is common to use a method in which a detection threshold value Vth is set to an output value between the ink level h (C) and the ink level h (Emp), i.e., is provided between c1 and V_Emp. With this, it becomes possible to detect the remaining amount in a period from when the ink liquid surface becomes lower than the tip of the electrode pin 10 until when the sub-tank liquid chamber 8 becomes empty.

When the remaining amount detection output value relative to the ink remaining amount is constant, it is possible to detect the remaining amount with high accuracy by setting the threshold value in a manner described above. However, when a metal material such as an SUS material (SUS304) is used as the material of the electrode pins 10*a* and 10*b* and an operation of causing a current to flow in one direction between the electrode pins 10*a* and 10*b* via the ink is repeated, there are cases where an oxidation-reduction reaction occurs on the surfaces of the electrode pins 10*a* and 10*b*. The oxidation-reduction reaction is, e.g., a phenomenon in which oxidation progresses on the surface of the anode-side electrode pin 10*a*, and reduction progresses on the surface of the cathode-side electrode pin 10*b*. When such a reaction progresses, the electrical resistance is increased due to an influence of oxidation of the anode-side electrode pin 10*a*, and hence the current value of the current flowing between the electrode pins 10*a* and 10*b* is decreased irrespective of the state in which the ink is present, and the remaining amount detection output is increased.

Figure 5A:
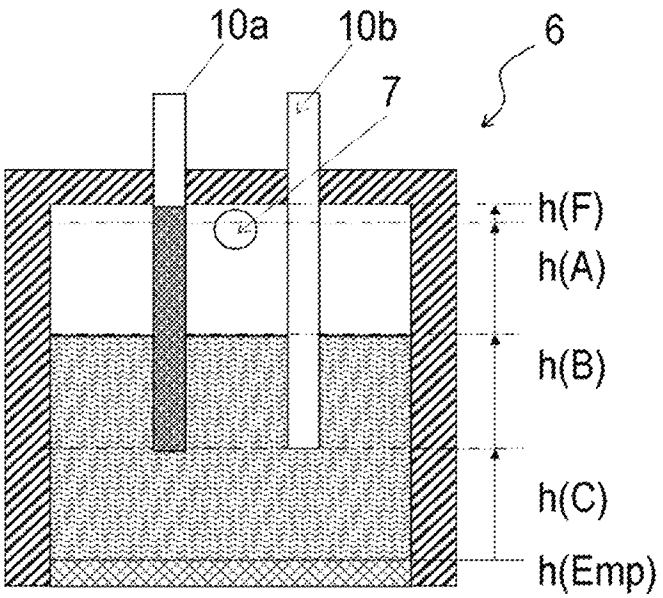
FIG. 5A and FIG. 5B are views showing an example of the output signal after oxidation of a first electrode pin (anode side)
Figure 5B:
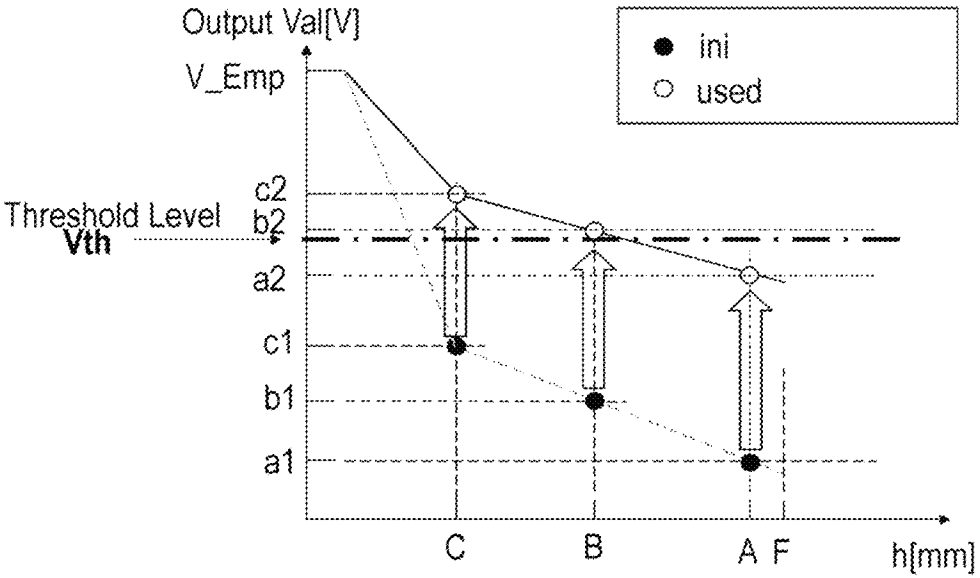

FIG. 5A is a schematic cross-sectional view of the sub-tank liquid chamber 8 in a state in which the anode-side electrode pin 10*a* is oxidized, and FIG. 5B shows the change of the output between an initial=pre-oxidation-reduction (ini) state and a state after the oxidation and reduction of the electrode pin 10 (used). In the initial (ini) state, it is possible to perform the remaining amount detection at a desired remaining amount by setting the detection threshold value to the remaining amount detection output between h (C) at which the ink liquid surface is flush with the pin tip and h (Emp) at which the sub-tank liquid chamber is empty, i.e., setting the detection threshold value between c1 and V_Emp. However, when oxidation occurs in the anode-side electrode pin 10*a* due to accumulation of current application, the output value is significantly increased and, in the case where the detection threshold value is set to a constant value, the remaining amount can be detected early before a targeted remaining amount is reached (in a state in which the pin is immersed in the ink adequately). When the remaining amount is detected early, a bad effect such as urging the user to replace the ink tank 3 or frequently reducing printing speed irrespective of a state in which the ink remains sufficiently is caused. It is possible to change the detection threshold value according to the number of pulses given to the electrode pin 10. However, output change caused by oxidation is varied due to the individual difference of the electrode pin 10, and hence it becomes difficult to obtain high detection accuracy.

Based on the above situation, a configuration for preventing the oxidation-reduction phenomenon of the electrode pin 10 caused by current application in one direction and suppressing the change of the remaining amount detection output, which is a characteristic part of the present embodiment, will be described by using FIG. 6A and FIG. 6B.

Figure 6A:
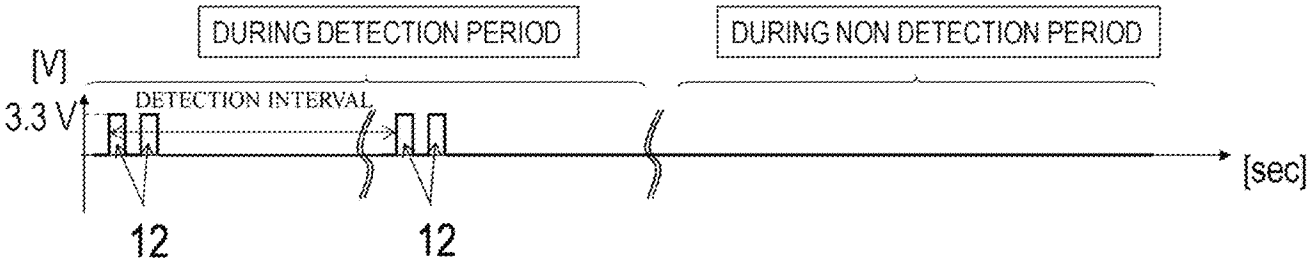
FIG. 6A and FIG. 6B are views showing examples (a conventional example, Example 1) of a signal mode of the ink remaining amount detection.

FIG. 6A shows a signal mode of the remaining amount detection which has been adopted conventionally. Statuses of the ink detection roughly include "detection period" and "non-detection period". The detection period denotes a predetermined period in which not a standby state where, e.g., the liquid ejection cartridge unit 2 is capped but a state where a printing operation or the like is performed is established, and the ink remaining amount is detected. On the other hand, the non-detection period denotes a predetermined period in which the standby state where, e.g., the liquid ejection cartridge unit 2 is capped is established, and the detection operation of the ink remaining amount is not performed. During the detection period, as described above, two rectangular pulses are successively applied at a detection interval as remaining amount detection pulses 12. On the other hand, during the non-detection period, a signal is not applied and a level of 0 V is maintained.

Figure 6B:
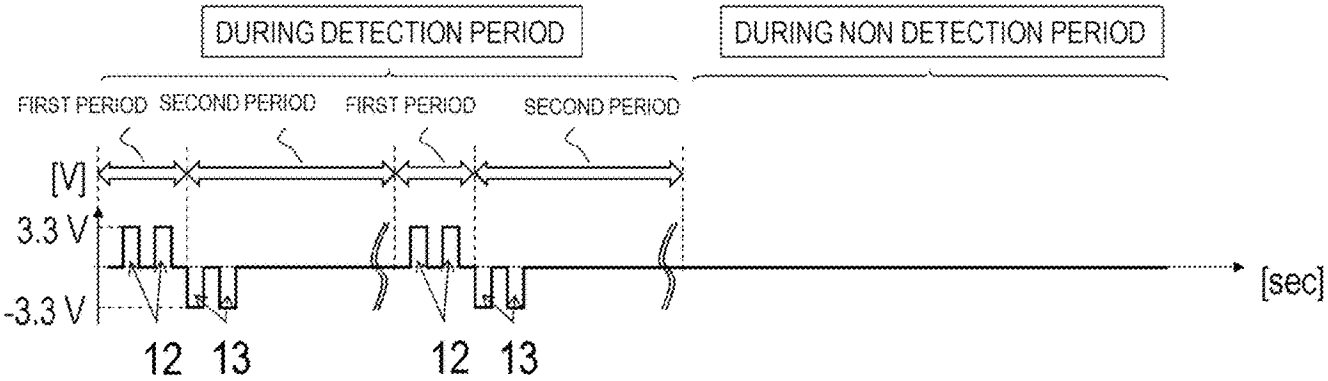

In contrast, the signal mode in Example 1 of the present invention is shown in FIG. 6B. In the present example, during the detection period, there are provided "a first period" serving as a period in which the remaining amount detection pulse 12 having 3.3 V, which is identical to that in the conventional example, is applied, and "a second period" serving as a period in which a signal obtained by inverting the potential of the remaining amount detection pulse 12=a reduction pulse 13 is applied. By applying the reduction pulse 13, it becomes possible to exert, during the second period, reduction action on the anode-side electrode pin 10*a* which is oxidized by the application of the remaining amount detection pulse 12 during the first period to cancel the oxidation and suppress an increase in remaining amount detection output. In the present method, it becomes possible to reduce the oxidation of the anode-side electrode pin 10*a* every time the remaining amount detection is performed, and hence it is possible to perform more stable and high-accuracy remaining amount detection.

In the present example, a length of an application accumulated time of a voltage signal in the first period and a length of an application accumulated time of the voltage signal in the second period are substantially identical to each other, and an absolute value of a voltage value of an application signal in the first period and that in the second period are also substantially identical to each other (voltage levels are substantially identical to each other). For example, the application accumulated time in the second period is controlled such that a difference between the application accumulated time in the second period and the application accumulated time in the first period falls within ±10% of the length of the application accumulated time in the first period.

Various types of inks can be used as the target ink to be detected and, in the present example, among self-dispersion type pigments, it is assumed that an ink which uses carboxylic acid type self-dispersion type carbon black is selected and used in consideration of image performance and material cost. In the above ink, it is determined that the output is increased due to the oxidation phenomenon of the electrode pin 10*a* caused by the application of the remaining amount detection pulse 12, and the increase of the output is suppressed by the application of the reduction pulse 13, and it is possible to obtain an effect of implementation of the present invention. Note that the oxidation phenomenon occurs in the case where other inks are used, and hence it is possible to obtain the effect.

As described thus far, according to the present embodiment, even in the case where oxidation occurs on the surface of a first electrode pin (anode side) due to the signal applied during the remaining amount detection period, it is possible to effect the reduction action by applying the signal of which the polarity is inverted during the non-remaining amount detection period to suppress the progress of oxidation of the electrode pin. In particular, in the case where the metal material (SUS304, SUS384, SUS316) which tends to effect the oxidation action on the electrode pin 10 is used and the ink which tends to effect the oxidation action is used, it is possible to suppress the oxidation of the electrode pin. That is, it is possible to suppress an increase in the electrical resistance of the electrode pin surface, and maintain the current value of the current flowing between the electrode pins in the state in which the ink is present at a constant level. Consequently, it is possible to obtain stable and higher detection accuracy and, therefore, perform the ink remaining amount detection with high accuracy.

In the mode in which the ink supply of the tube supply method is performed, in some cases, air can passe through and enter the tube due to leaving the tube for a long period, or air can be present irregularly in a supply path and ejection can be thereby influenced. In order to detect such an influence on printing to prevent idle ejection, the configuration of the present embodiment capable of performing the ink remaining amount detection with high accuracy is effective.

In the present embodiment, while the present invention is applied to the ink remaining amount detection in the liquid ejection cartridge unit 2, the present invention can also be applied to the ink presence-absence detection in the ink tank 3 or in other ink supply paths.

On the contrary to the present embodiment, a configuration may also be adopted in which the remaining amount detection is performed with the second electrode pin 10*b* being used as the anode side and the first electrode pin 10*a* being used as the cathode side, the polarities of the electrode pins are interchanged, and the reduction application is then performed with the second electrode pin 10*b* being used as the cathode side and the first electrode pin 10*a* being used as the anode side.

In the present embodiment, the electrode pin is inserted into the liquid chamber vertically downward from above, but the insertion direction is not limited. In addition, the number of electrode pins is not limited to two. For example, it is also possible to dispose a plurality of anode pins with respect to one cathode pin and perform detection, and the detection accuracy may be increased by making penetration depths of the electrode pins into the liquid different from each other or setting a plurality of detection positions in the liquid chamber by using three or more electrode pins.

Second Embodiment

FIG. 7A to FIG. 8C show examples of the signal mode of the remaining amount detection by a second embodiment of the present invention. Herein, only points in the second embodiment which are different from the first embodiment will be described. An object of the following signal mode of the remaining amount detection is, similarly to that described in the first embodiment, to suppress the oxidation of the anode-side electrode pin 10*a* caused by the application of the remaining amount detection pulse 12 and suppress the change of the remaining amount detection output.

Figure 7A:
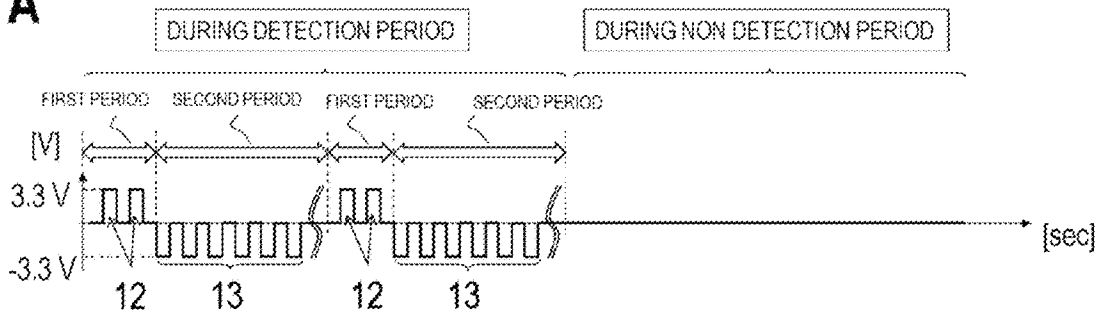
FIG. 7A to FIG. 7C are views showing examples (Examples 2, 3, and 4) of the signal mode of the ink remaining amount detection.

Example 2 shown in FIG. 7A is characterized in that the reduction pulses 13 greater in number than the remaining amount detection pulses 12 are applied during the remaining amount detection period. That is, the application accumulated time of the voltage signal applied in the second period is longer than the application accumulated time of the voltage signal applied in the first period. In the present example, relative to two detection pulses 12, six reduction pulses 13 which are three times as many as the detection pulses 12 are applied. In some cases, depending on the material of the electrode pin 10 and the physical properties of ink, the reaction speed of oxidation can be different from that of reduction. To cope with this, by allowing the adjustment of the number of reduction pulses 13 relative to the number of remaining amount detection pulses 12, it is possible to adopt a condition which allows the remaining amount detection output to be maintained at a constant level irrespective of the degree of progress of oxidation which differs depending on the electrode pin 10 and the ink.

Figure 7B:
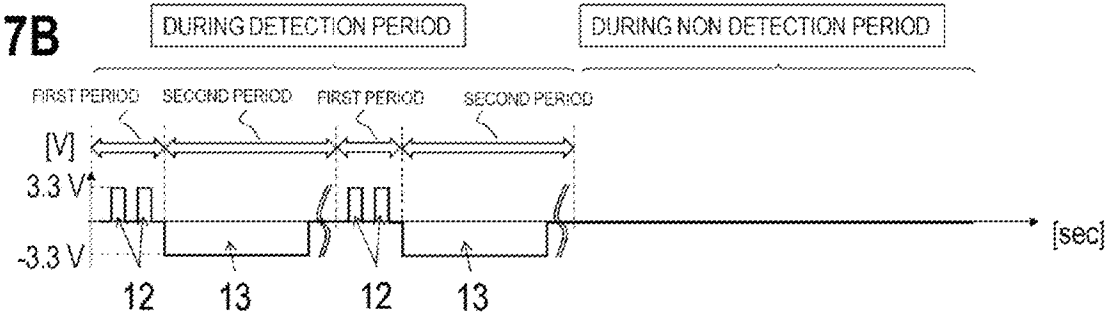

As in Example 3 shown in FIG. 7B, a signal having a DC-like long pulse width may be used as the reduction pulse 13. That is, the pulse width of the voltage signal applied in the second period is longer than the pulse width of the voltage signal applied in the first period. By causing reduction to progress with a DC-like current, in some cases, it is possible to complete reduction control in a shorter period.

Figure 7C:
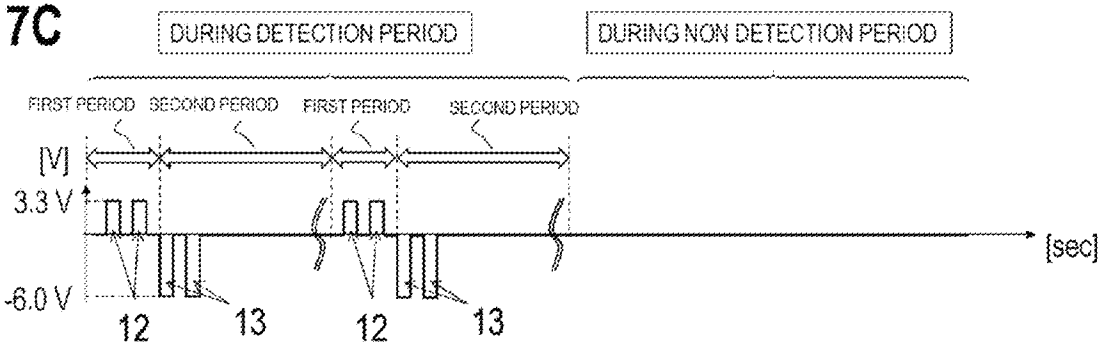

As in Example 4 shown in FIG. 7C, a signal having a voltage level different from that of the remaining amount detection pulse 12 may also be used as the reduction pulse 13. That is, the absolute value of the voltage signal applied in the second period is greater than the absolute value of the voltage signal applied in the first period. By using the reduction pulse 13 having the potential higher than the voltage of the remaining amount detection pulse 12 to cause a higher current to flow during the reduction, it is possible to complete the reduction control in a shorter period in some cases. In the present example, a method in which potential inversion is performed on a voltage of 6 V used in other drives of the image recording apparatus and the voltage is applied is adopted, but other potentials (e.g., 24 V and the like) may also be applied.

Figure 8A:
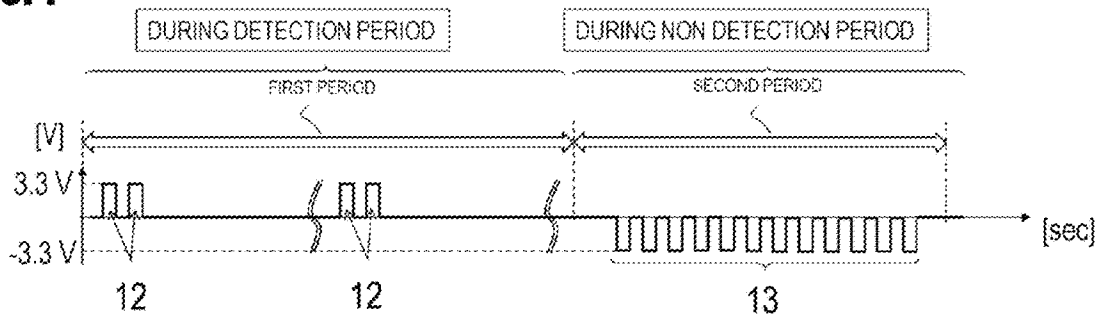
FIG. 8A to FIG. 8C are views showing examples (Examples 5, 6, and 7) of the signal mode of the ink remaining amount detection.

In Example 5 shown in FIG. 8A, similarly to the conventional example, only the remaining amount detection pulse 12 is applied during the ink remaining amount detection period, and the reduction pulse 13 is successively applied during the non-detection period. This method is effective in the case where the remaining amount detection is performed at higher frequency during the detection period. In the case where the remaining amount detection is performed at high frequency, it becomes difficult to apply the reduction pulse 13 every time the detection is performed. Accordingly, only the reduction pulse 13 is successively applied in the non-detection period without applying the reduction pulse 13 during the detection period. Note that the remaining amount detection pulse 12 may also be applied successively in the detection period.

Figure 8B:
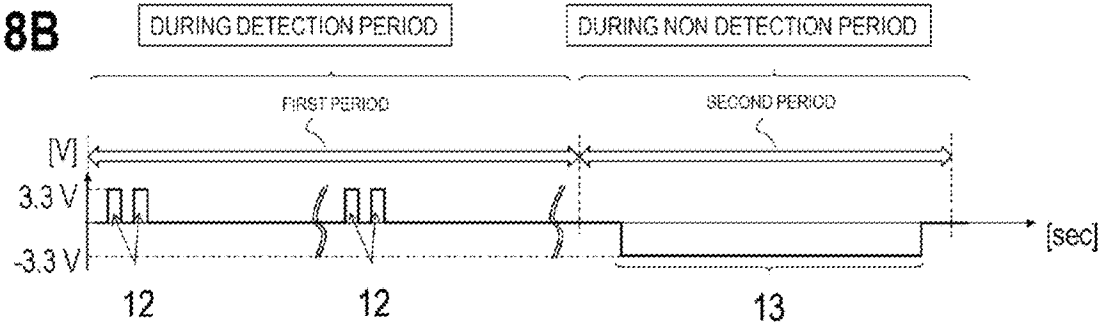

As in Example 6 shown in FIG. 8B, in contrast to the method in FIG. 8A, a signal having a DC-like long pulse width may be used as the reduction pulse 13.

Figure 8C:
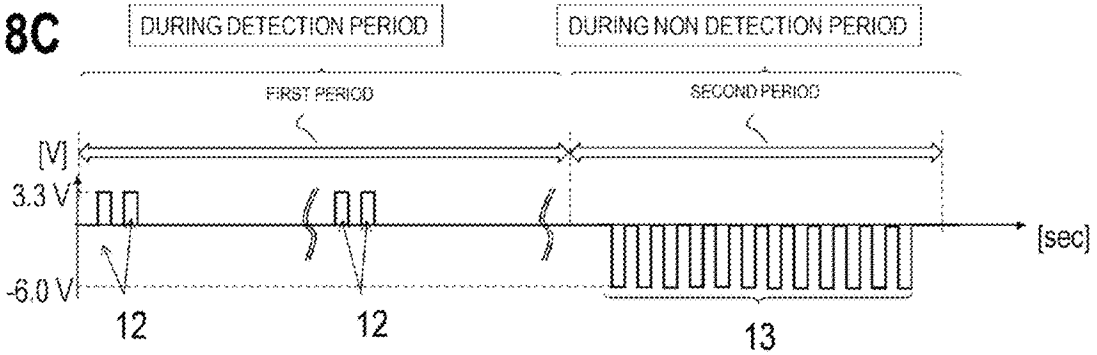

As in Example 7 shown in FIG. 8C, in contrast to the method in FIG. 8A, a signal having a voltage level different from that of the remaining amount detection pulse 12 may be used as the reduction pulse 13.

As in each example described above, the proper reduction pulse 13 may be used appropriately according to various restrictions such as the electrode pin 10 to be used, an ink recipe, and a detection interval.

Modification

Figure 9A:
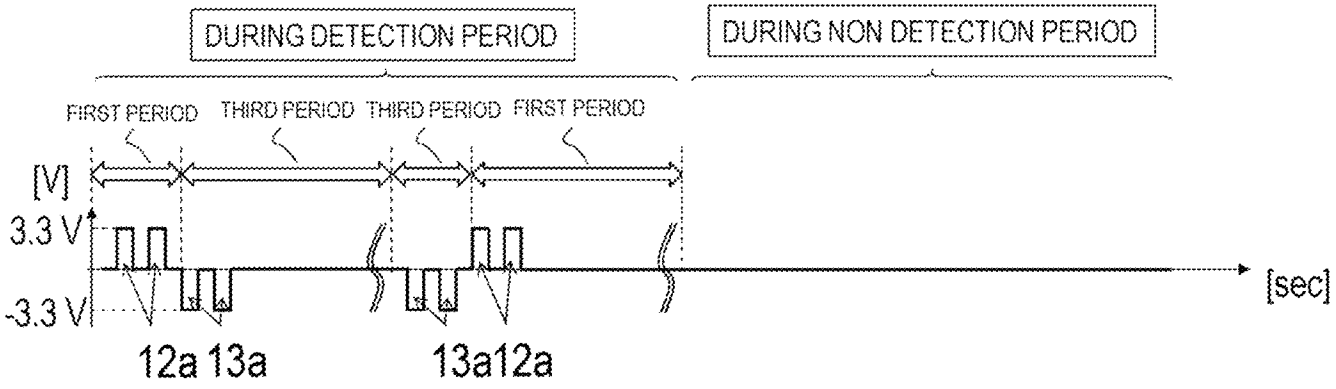
FIG. 9A and FIG. 9B are views showing examples (Modifications 1 and 2) of the signal mode of the ink remaining amount detection.
Figure 9B:
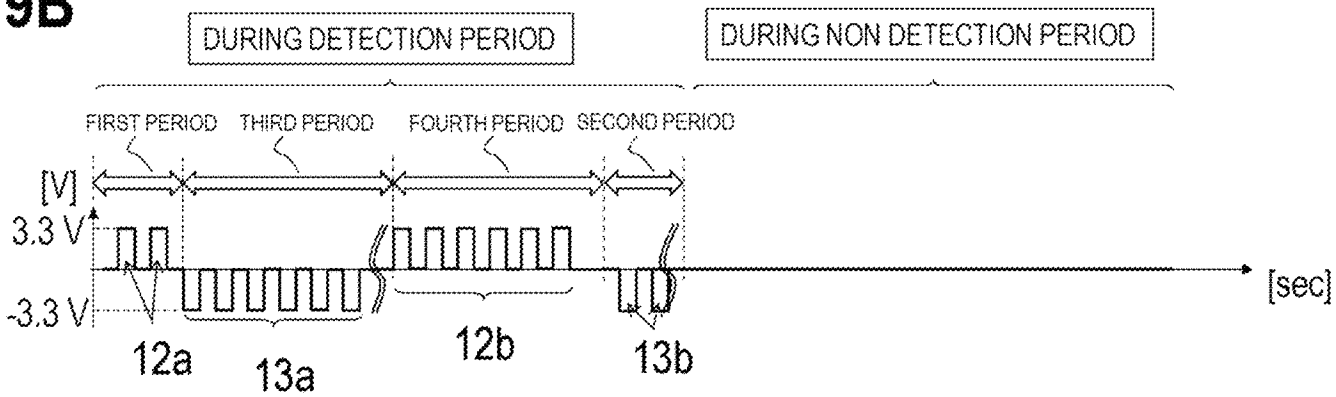

FIG. 9A and FIG. 9B shows examples of the signal mode of the remaining amount detection according to modifications of the present embodiment. Herein, only points in the modifications which are different from the first and second embodiments will be described. Matters in the modifications which are not described herein are identical to those in the above embodiments.

In the above embodiments, the remaining amount detection is performed with the first electrode pin 10*a* being used as the anode side and the second electrode pin 10*b* being used as the cathode side, but it is possible to perform the remaining amount detection after the polarity is inverted. In the present modifications, there are provided a third period in which the remaining amount detection is performed with the second electrode pin 10*b* being used as the anode side and the first electrode pin 10*a* being used as the cathode side, and a fourth period in which the reduction application is performed with the first electrode pin 10*a* being used as the anode side and the second electrode pin 10*b* being used as the cathode side, and the remaining amount detection is not performed.

In Modification 1 shown in FIG. 9A, the remaining amount detection pulse 12*a* is applied with the electrode pin 10*a* being used as the anode side and the electrode pin 10*b* being used as the cathode side in the first period, and the remaining amount detection pulse 13*a* is applied with the electrode pin 10*b* being used as the anode side and the electrode pin 10*a* being used as the cathode side in the third period. With this, in the third period, it becomes possible to perform the detection of the ink remaining amount while reducing the oxidation caused by the voltage application in the first period. The order of setting of the first period and the third period may be reversed, and the number of pulses, the width of the pulse, and the level of the pulse may differ. Similarly to the above embodiments, the second period in which the reduction pulse is applied may also be provided in order to strike a balance between the oxidation and the reduction.

In Modification 2 shown in FIG. 9B, control in which the second period for reduction in which a combination of the polarities of the electrode pins is changed and the fourth period are combined is performed. That is, after the first period, the remaining amount detection pulses 13*a* of which the number is increased to be greater than that in the first period are applied in the third period and, thereafter, the fourth period in which the reduction pulses 12*b* corresponding to the third period are applied is provided. The oxidation caused by the remaining amount detection pulses 13*a* in the third period is reduced by the reduction pulses 12*b* in the fourth period. In addition, after the fourth period, the second period in which the reduction pulse 13*b* for reducing the oxidation caused by the remaining amount detection pulse 12*a* in the first period is applied is provided.

According to the modifications described above, in the case where the application of the remaining amount detection pulse needs to be performed frequently, it is possible to perform the remaining amount detection while effectively suppressing the progress of the oxidation. In addition, it is possible to reduce the number of times of the application of the reduction signal or eliminate the application of the reduction signal, and hence it can be expected that apparatus life will be extended.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-104689, filed on Jun. 17, 2020, which is hereby incorporated by reference herein in its entirety.

What is claimed is:

1. An image recording apparatus comprising:

a liquid chamber which stores liquid used for recording of an image;

a first electrode pin and a second electrode pin which are inserted into the liquid chamber;

application unit for applying a voltage between the first electrode pin and the second electrode pin; and detection unit for detecting a current which flows between the first electrode pin and the second electrode pin, wherein the image recording apparatus has a first period in which the application unit applies the voltage between the first electrode pin and the second electrode pin, with the first electrode pin being used as an anode side and the second electrode pin being used as a cathode side, and the detection unit detects the current, and a second period in which the application unit applies the voltage between the first electrode pin and the second electrode pin, with the first electrode pin being used as the cathode side and the second electrode pin being used as the anode side.

2. The image recording apparatus according to claim 1, further comprising:

a liquid ejection cartridge unit; and a liquid supply tube which supplies the liquid from the liquid chamber to the liquid ejection cartridge unit.

3. The image recording apparatus according to claim 1, further comprising:

a liquid tank;

a liquid ejection cartridge unit which has a recording element substrate and a sub-tank; and a liquid supply tube which supplies the liquid from the liquid tank to the sub-tank, wherein the liquid chamber is a liquid chamber of the sub-tank, and supplies the liquid supplied from the liquid supply tube to the recording element substrate.

4. The image recording apparatus according to claim 1, further comprising:

a liquid tank; and a liquid ejection cartridge unit which has a recording element substrate and a sub-tank connected to the liquid tank, wherein the liquid chamber is a liquid chamber of the sub-tank, and temporarily retains the liquid supplied from the liquid tank and supplies the liquid to the recording element substrate.

5. The image recording apparatus according to claim 1, wherein a difference between a length of an application accumulated time of the voltage applied in the first period and a length of an application accumulated time of the voltage applied in the second period falls within ±10% of the length of the application accumulated time of the voltage applied in the first period.

6. The image recording apparatus according to claim 1, wherein an application accumulated time of the voltage applied in the second period is longer than an application accumulated time of the voltage applied in the first period.

7. The image recording apparatus according to claim 1, wherein a pulse width of the voltage applied in the second period is longer than a pulse width of the voltage applied in the first period.

8. The image recording apparatus according to claim 1, wherein an absolute value of the voltage applied in the second period is greater than an absolute value of the voltage applied in the first period.

9. The image recording apparatus according to claim 1, wherein the first period is provided in plurality during a predetermined detection period for detecting a remaining amount of the liquid in the liquid chamber, and the second period is provided in plurality during a non-detection period different from the detection period.

10. The image recording apparatus according to claim 9, wherein the plurality of the second periods are provided successively during the non-detection period.

11. The image recording apparatus according to claim 1, wherein the liquid is an ink which uses self-dispersion type carbon black.

12. An image recording apparatus comprising:

a liquid chamber which stores liquid used for recording of an image;

a first electrode pin and a second electrode pin which are inserted into the liquid chamber;

application unit for applying a voltage between the first electrode pin and the second electrode pin; and detection unit for detecting a current which flows between the first electrode pin and the second electrode pin, wherein the image recording apparatus has a first period in which the application unit applies the voltage between the first electrode pin and the second electrode pin, with the first electrode pin being used as an anode side and the second electrode pin being used as a cathode side, and the detection unit detects the current, and a third period in which the application unit applies the voltage between the first electrode pin and the second electrode pin, with the first electrode pin being used as the cathode side and the second electrode pin being used as the anode side, and the detection unit detects the current.

13. The image recording apparatus according to claim 12, wherein the image recording apparatus further has a second period in which the application unit applies the voltage between the first electrode pin and the second electrode pin, with the first electrode pin being used as the cathode side and the second electrode pin being used as the anode side, and a fourth period in which the application unit applies the voltage between the first electrode pin and the second electrode pin, with the first electrode pin being used as the anode side and the second electrode pin being used as the cathode side.

* * * * *